US007644688B2

(12) United States Patent
Marriott et al.

(10) Patent No.: US 7,644,688 B2
(45) Date of Patent: Jan. 12, 2010

(54) VALVE ACTUATOR ASSEMBLY HAVING A CENTER BIASED SPOOL VALVE WITH DETENT FEATURE

(75) Inventors: Craig D. Marriott, Clawson, MI (US); Zongxuan Sun, Troy, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 202 days.

(21) Appl. No.: 11/417,097

(22) Filed: May 3, 2006

(65) Prior Publication Data

US 2007/0256651 A1 Nov. 8, 2007

(51) Int. Cl.
*F01L 9/02* (2006.01)

(52) U.S. Cl. ..... 123/90.12; 123/90.15; 137/625.65

(58) Field of Classification Search ..... 123/90.12, 123/90.13, 90.15; 137/625.65
See application file for complete search history.

(56) References Cited

U.S. PATENT DOCUMENTS 4,860,781 A * 8/1989 Fairman ..... 137/118.03
6,722,385 B1 * 4/2004 Bolaski ..... 137/15.17
6,959,673 B2 11/2005 Sun ..... 123/90.12
2004/0250781 A1 * 12/2004 Sun ..... 123/90.12

* cited by examiner

*Primary Examiner*—Zelalem Eshete

(57) ABSTRACT

A valve actuator assembly for an engine includes a movable poppet valve, and movable first and second spool valves. The assembly also includes an intermediate channel interconnecting the first and second spool valve, a driving channel, and a first and second feedback channel interconnecting the second spool valve and the poppet valve. The valve actuator assembly includes an actuator cooperating with the first spool valve to position the first spool valve to selectively allow high pressure fluid flow to the second spool valve and the driving channel to position the engine valve. The valve actuator assembly further includes a first and second on/off valve in respective fluid communication with the first feedback channel and the second feedback channel to selectively exhaust the first and second feedback channel to control motion of the second spool valve. The second spool valve includes a detent feature operable to maintain the second spool valve in a center biased position.

7 Claims, 2 Drawing Sheets

VALVE ACTUATOR ASSEMBLY HAVING A CENTER BIASED SPOOL VALVE WITH DETENT FEATURE

GOVERNMENT LICENSE RIGHTS

The U.S. Government has a paid-up license in this invention and the right in limited circumstances to require the patent owner to license others on reasonable terms as provided for by the terms of DE-FC-26-05NT42415 awarded by DOE.

TECHNICAL FIELD

The present invention relates to valve actuator assemblies for an internal combustion engine.

BACKGROUND OF THE INVENTION

It is known to provide a valve train or valve actuator assembly for an internal combustion engine of a vehicle. Typically, the valve train includes one or more intake and exhaust valves, a camshaft, driven by the engine, having at least one or more cams, and a rocker arm operatively connected with each cam and valve.

More recently, camless valve trains for internal combustion engines have been developed. Because of the ability to provide valve lift profiles tailored to specific engine operating conditions to improve engine performance, the camless valve train has been met with much enthusiasm by the internal combustion engine design community.

SUMMARY OF THE INVENTION

A valve actuator assembly for an internal combustion engine is provided having a housing, a movable poppet valve, and a movable first spool valve. Also provided is a movable second spool valve having a center biased position and detent feature. A driving channel interconnects the second spool valve and the poppet valve, while an intermediate channel interconnects the first spool valve and the second spool valve. A first feedback channel interconnects the second spool valve and the poppet valve and a second feedback channel interconnects the second spool valve and the poppet valve. An actuator operatively cooperates with the first spool valve to position the first spool valve to selectively allow fluid flow into and out of the second spool valve and the driving channel to position the poppet valve. A first on/off valve is provided in fluid communication with the first feedback channel to selectively exhaust the first feedback channel. A second on/off valve is provided in fluid communication with the second feedback channel to selectively exhaust the second feedback channel, whereby the first on/off valve and the second on/off valve control motion of the second spool valve.

The housing may define a first fluid chamber in fluid communication with the driving channel and a second fluid chamber in fluid communication with the first feedback channel. Additionally, a first on/off valve channel may interconnect the second fluid chamber and the first on/off valve, while a second on/off valve channel may interconnect the third fluid chamber and the second on/off valve. The housing may further define a third fluid chamber in fluid communication with the second feedback channel. The valve actuator assembly may further include a second piston operatively cooperating with the poppet valve, wherein the second piston is disposed in the housing and has the third fluid chamber on one side thereof.

A fourth fluid chamber may be defined by the housing and disposed at one end of the second spool valve and provided in fluid communication with the first feedback channel. A fifth fluid chamber may be defined by the housing and disposed at one end of the second spool valve opposite the fourth fluid chamber and provided in fluid communication with the second feedback channel. A second spool valve spring and retainer may be at least partially disposed within the fourth fluid chamber and operate to bias the second spool valve toward the center biased position. A third spool valve spring and retainer may be at least partially disposed within the fifth fluid chamber and operate to bias the second spool valve toward the center biased position. The second spool valve spring and retainer and the third spool valve spring and retainer cooperate to provide the detent feature to the second spool valve. An internal combustion engine incorporating the disclosed valve actuator assembly is also provided.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
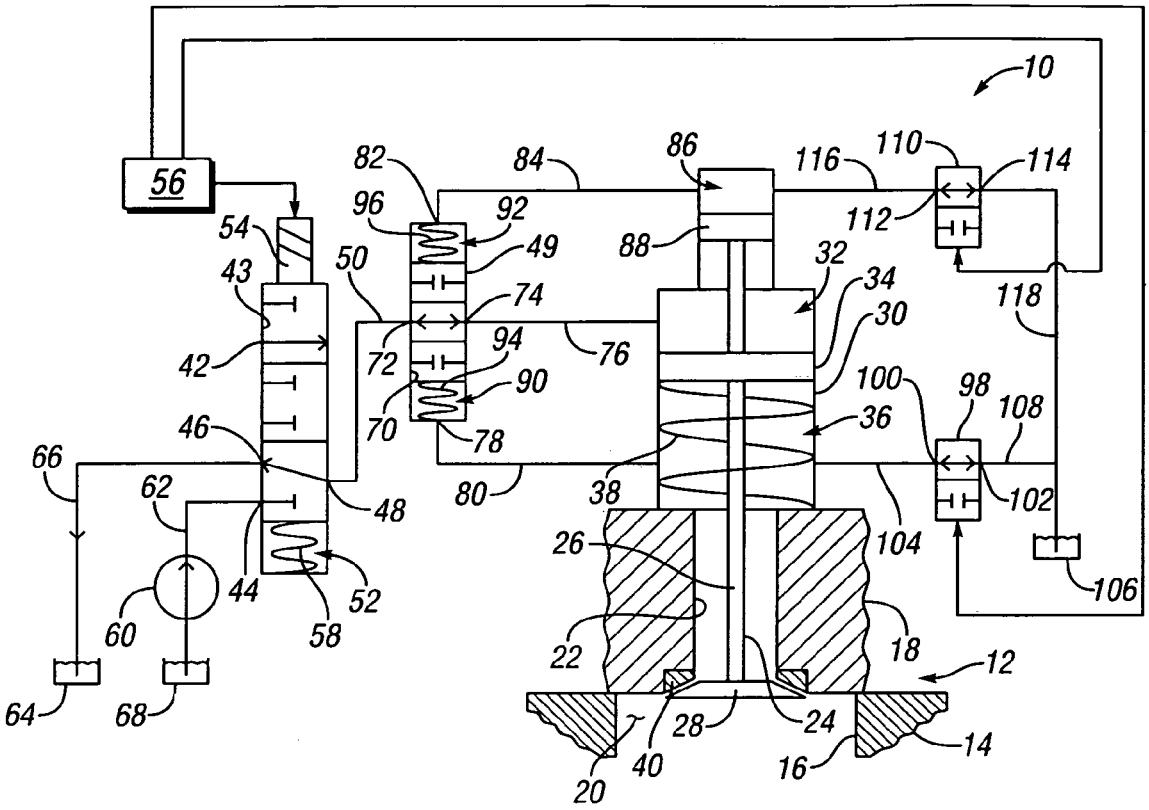
FIG. 1 is a schematic diagrammatic representation of a valve actuator assembly, in accordance with the present invention, illustrated in operational relationship with an engine of a vehicle.

Referring to the drawings wherein like reference numbers correspond to like or similar components throughout the several figures, there is shown in FIG. 1 a valve actuator assembly 10 in accordance with the present invention. The valve actuator assembly 10 is adapted for use with an engine, generally indicated at 12, of a vehicle, not shown. The engine 12 is of an internal combustion type, such as a spark ignited or compression ignited engine. The engine 12 includes an engine block 14 defining a cylinder bore 16 having a piston, not shown, reciprocally movable therein. Removably mounted to the engine block 14 and closing one end of the cylinder bore 16 is a cylinder head 18. The cylinder bore 16, cylinder head 18, and piston cooperate to form a variable volume combustion chamber 20. The cylinder head 18 defines at least one port or opening 22 therein in selective communication with the combustion chamber 20. The engine 12 also includes a movable poppet valve 24 to selectively open the port 22 to the combustion chamber 20. The poppet valve 24 has a valve stem portion 26 and a valve head portion 28 disposed at one end of the valve stem portion 26. It should be appreciated that the poppet valve 24 may be either an intake or an exhaust valve, while the respective port 22 may be either an intake or exhaust port. It should also be appreciated that the valve actuator assembly 10 operates as a camless valve train for the engine 12.

Figure 3:
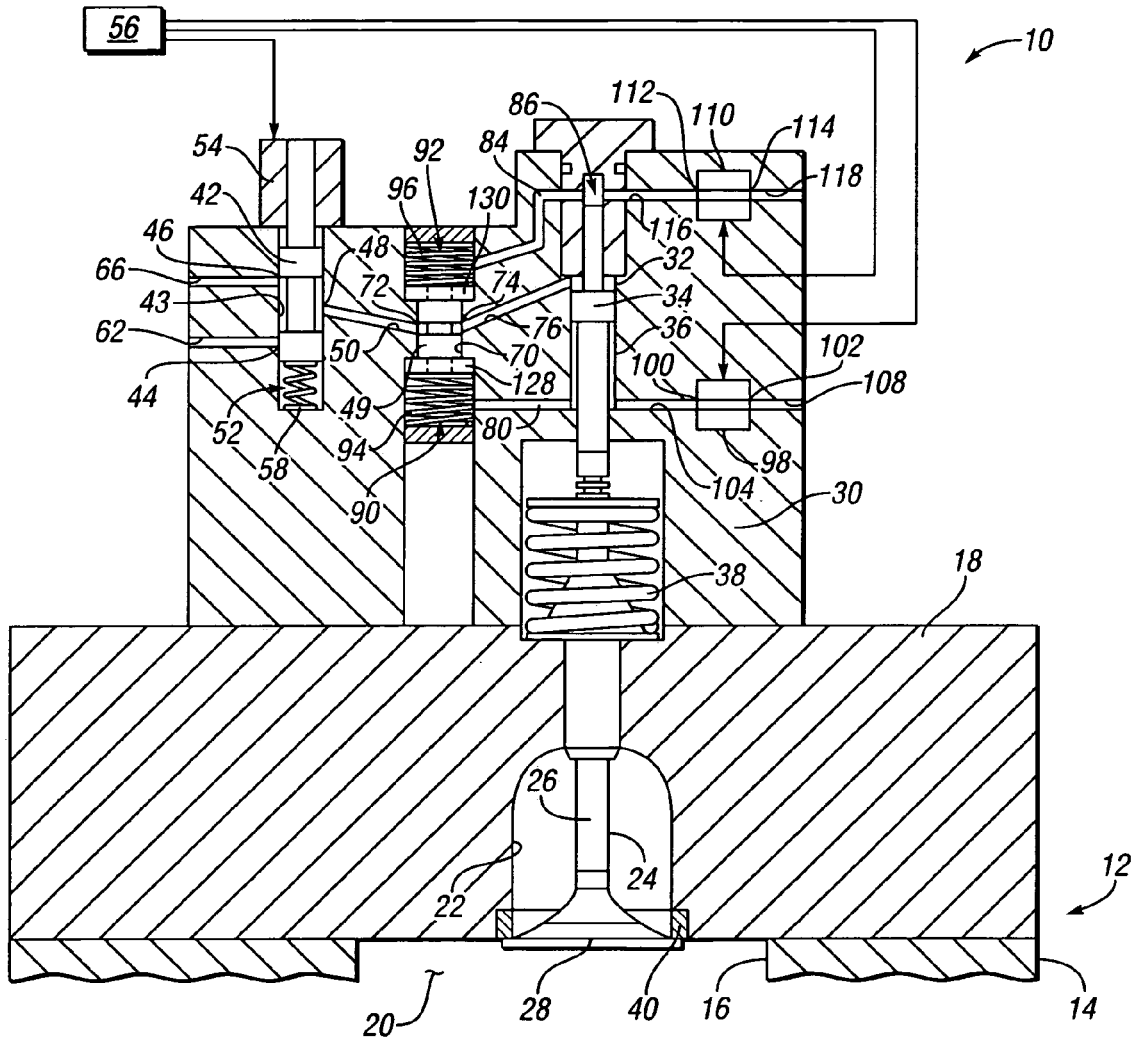
FIG. 3 is a partial cross sectional view of the valve actuator assembly of FIG. 1 incorporating the second spool valve illustrated in FIG. 2.

The valve actuator assembly 10 includes a housing 30 mounted with respect to the cylinder head 18. The housing 30 defines a main or first fluid chamber 32. The valve actuator assembly 10 also includes a first piston 34 connected to, or in contact with, the valve stem portion 26 of the poppet valve 24. The first piston 34 is reciprocally movable within the first fluid chamber 32 of the housing 30 and forms a second fluid chamber 36 therein. The valve actuator assembly 10 includes a valve spring 38 coaxially disposed about the valve stem portion 26 and in contact with the cylinder head 18. The valve spring 38 operates to bias the poppet valve 24 toward the closed position, as shown in FIG. 3. It should be appreciated that the valve head portion 28 cooperates with a seat 40, mounted with respect to the cylinder head 18, to seal or close the port 22 when the poppet valve 24 is in the closed position.

The valve actuator assembly 10 also includes a first spool valve 42 reciprocally moveable within a bore 43 defined by the housing 30. The first spool valve 42 is in selective fluid communication with the first fluid chamber 32 of the housing 30. The first spool valve 42 is of a three-position three-way type. The first spool valve 42 has a high pressure port 44 and a low pressure port 46. The first spool valve 42 also has a first fluid chamber port 48 in fluid communication with a second spool valve 49, to be described, by an intermediate channel 50. The bore 43 and the first spool valve 42 cooperate to define a chamber 52. It should be appreciated that the first spool valve 42 controls fluid flow to and from the second spool valve 49.

The valve actuator assembly 10 includes an actuator 54 at an end of the first spool valve 42 opposite the chamber 52. The actuator 54 is preferably of a linear type such as a solenoid electrically connected to a source of electrical power such as a controller 56. The valve actuator assembly 10 further includes a first spool valve spring member 58 disposed within the chamber 52 and operable to bias the first spool valve 42 toward the actuator 54. It should be appreciated that the controller 56 selectively and variably energizes the actuator 54 to move the first spool valve 42 within the bore 43 against the bias force of the first spool valve spring member 58.

The valve actuator assembly 10 also includes a positive displacement hydraulic pump 60 and a high pressure line 62 fluidly interconnecting the hydraulic pump 60 and the high pressure port 44. The valve actuator assembly 10 includes a fluid reservoir 64 and a low pressure line 66 fluidly interconnecting the fluid reservoir 64 and the low pressure port 46. It should be appreciated that the hydraulic pump 60 may be in fluid communication with the fluid reservoir 64 or a separate fluid reservoir 68, as shown in FIG. 1.

As stated hereinabove, the valve actuator assembly 10 includes the second spool valve 49 disposed in fluid communication with the first fluid chamber 32 of the housing 30. The second spool valve 49 is in fluid communication with the first spool valve 42. The second spool valve 49 is of a three-position two-way type and is reciprocally movable within bore 70 defined by the housing 30. Additionally the second spool valve 49 has a center biased position and a detent feature. The detent feature operates to maintain the second spool valve 49 in the center biased position. The second spool valve 49 has a first port 72 in fluid communication with the first spool valve 42 by the intermediate channel 42, and a second port 74 in fluid communication with the first fluid chamber 32 by a driving channel 76. The second spool valve 49 also includes a third port 78 fluidly connected by a first feedback channel 80 to the second fluid chamber 36 and a fourth port 82 fluidly connected by a second feedback channel 84 to a third fluid chamber 86, to be described hereinbelow. It should be appreciated that the second spool valve 49 selectively and variably controls fluid flow to the first fluid chamber 32.

The valve actuator assembly 10 includes a third fluid chamber 86 defined by the housing 30. The valve actuator assembly 10 also includes a second piston 88 operatively connected to the first piston 34 and reciprocally movable within the third fluid chamber 86 of the housing 30. The bore 70 and second spool valve 49 cooperate to define a fourth fluid chamber 90 at one end of the second spool valve 49, which is in fluid communication with the third port 78. Further, the bore 70 and second spool valve 49 cooperate to define a fifth fluid chamber 92 at one end of the second spool valve 49 opposite the fourth fluid chamber 90 and in fluid communication with the fourth port 82.

The valve actuator assembly 10 includes a second spool valve spring 94 disposed within the fourth fluid chamber 90 and operable to bias the second spool valve 49 toward the center biased position within bore 70. Similarly, the valve actuator assembly 10 also includes a third spool valve spring 96 disposed within the fifth fluid chamber 92 and operable to bias the second spool valve 49 toward the center biased position within bore 70. It should be appreciated that fluid pressure of sufficient magnitude within either the fifth fluid chamber 92 to overcome the force of the second spool valve spring 94 or the fourth fluid chamber 90 to overcome the force of the third spool valve spring 96 will bias the second spool valve 49 away from the center biased position. The operation and structure of the second spool valve 49 will be described in greater detail hereinbelow with reference to FIGS. 2 and 3.

The valve actuator assembly 10 further includes a first on/off valve 98 disposed in fluid communication with the second fluid chamber 36. The first on/off valve 98 is preferably a two-way magnetically latchable type and is responsive to command signals issued by the controller 56. The first on/off valve 98 has a first port 100 and a second port 102. The first port 100 is in fluid communication with the second fluid chamber 36 through a first on/off valve channel 104. The valve actuator assembly 10 includes a fluid reservoir 106 in fluid communication with the second port 102 through a low pressure line 108. It should be appreciated that the fluid reservoir 106 may operate as a low pressure source. Those skilled in the art will recognize that the fluid reservoirs 64, 68, and 106 may be combined or separate, as shown in FIG. 1.

The valve actuator assembly 10 further includes a second on/off valve 110 in fluid communication with the third fluid chamber 86. The second on/off valve 110 is preferably a two-way magnetically latchable type and is responsive to command signals issued by the controller 56. The second on/off valve 110 has a first port 112 and a second port 114. The first port 112 is in fluid communication with the third fluid chamber 86 through a second on/off valve channel 116. The fluid reservoir 106 is in fluid communication with the second port 114 through a low pressure line 118. The low pressure line 118 is in fluid communication with the fluid reservoir 106.

Figure 2:
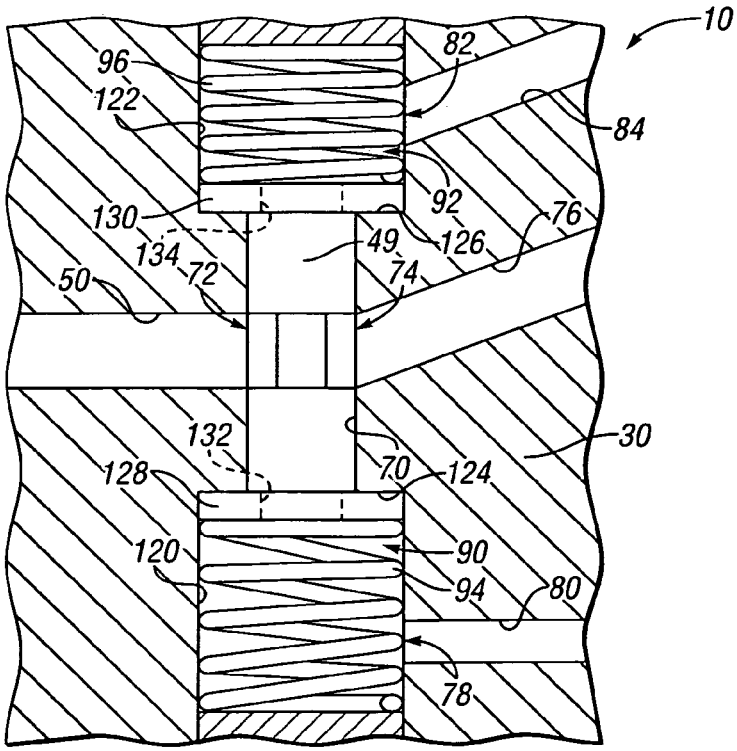
FIG. 2 is a partial cross sectional view of a portion of the valve actuator assembly schematically depicted in FIG. 1, illustrating a second spool valve having a detent feature.

Referring now to FIG. 2, there is shown a portion of the valve actuation mechanism 10 shown schematically in FIG. 1. As described hereinabove, the housing 30 defines the bore 70 within which the second spool valve 49 is movable. The housing 30 defines a bore 120 that further defines the fourth fluid chamber 90. Similarly, the housing 30 defines a bore 122 that further defines the fifth fluid chamber 92. The bores 120 and 122 are disposed at opposite ends of bore 70 and are generally larger in diameter than bore 70 such that respective lands 124 and 126 are formed. A first spring retainer 128 and second spring retainer 130 are disposed within the respective bores 120 and 122. The first spring retainer 128 is biased against land 124 by the force of spring 94, while the second spring retainer 130 is biased against land 126 by the force of spring 96. The first spring retainer 128 defines an orifice 132 sufficiently configured to allow pressurized fluid to act on the second spool valve 49 when the fourth fluid chamber 90 is pressurized by the first feedback channel 80. The second spring retainer 130 defines an orifice 134 sufficiently configured to allow pressurized fluid to act on the second spool valve 49 when the fifth fluid chamber 92 is pressurized by the second feedback channel 84. Preferably, the axial length of the second spool valve 49 is less than or equal to the axial length of the bore 70.

In operation, as the fluid pressure increases within the fourth fluid chamber 90, the bias force of the fluid pressure will seek to urge the second spool valve 49 upward, as shown in FIG. 2, within the bore 70. When the fluid pressure within the fourth fluid chamber 90 is of sufficient magnitude to overcome the bias force provided by spring 96, the second spool valve 49 will move within the bore 70 biasing the spring retainer 130 out of engagement with the land 126. It should be appreciated that the spring 94 does not provide a bias force to effect movement of the second spool valve 49. Alternately, as the fluid pressure increases within the fifth fluid chamber 92, the bias force of the fluid pressure will seek to urge the second spool valve 49 downward, as shown in FIG. 2, within the bore 70. When the fluid pressure within the fifth fluid chamber 90 is of sufficient magnitude to overcome the bias force provided by spring 94, the second spool valve 49 will move within the bore 70 biasing the spring retainer 128 out of engagement with the land 124. It should be appreciated that the spring 96 does not provide a bias force to effect movement of the second spool valve 49. The detent feature allows the second spool valve 49 to remain positioned in the center biased position within the bore 70 in the presence of slight pressure fluctuations or perturbations within either the fourth or the fifth fluid chamber 90 and 92. As the second spool valve 49 moves within the bore 70 from the center biased position, the flow of fluid between the intermediate channel 50 and the driving channel 76 is selectively and variably restricted.

Referring now to FIG. 3, there is shown a partial cross sectional view of the valve actuator assembly 10, shown schematically in FIG. 1, employing the second spool valve 49, as illustrated in FIG. 2. The operation of the valve actuator assembly 10 will now be discussed in greater detail with reference to FIGS. 1, 2, and 3. With the poppet valve 24 in a closed position, i.e. the head portion 28 is in contact with the seat 40 as illustrated in FIG. 3, the actuator 54 is de-energized by the controller 56 so that the first spool valve spring member 58 urges the first spool valve 42 upward, as viewed in FIG. 3, to expose the intermediate channel 50 to the low pressure line 66. The first and second on/off valves 98 and 110 are open so that both the second fluid chamber 36 and the third fluid chamber 86 are in fluid communication with the fluid reservoir 106. The second spool valve spring 94 and third spool valve spring 96 cooperate with the respective spring retainers 128 and 130 to hold or bias the second spool valve 49 in the center biased position as was described hereinabove with reference to FIG. 2. With the second spool valve 49 in the center biased position within the bore 70, as shown in FIG. 3, the first fluid chamber 32 is in fluid communication with the low pressure line 66 through the intermediate channel 50 and the driving channel 76. With the first fluid chamber 32, the second fluid chamber 36 and the third fluid chamber 86 exhausted or in communication with their respective low pressure line 66, 108, and 118, the valve spring 38 biases the poppet valve 24 into the closed position thereby disallowing communication between the port 22 and the combustion chamber 20.

To bias the poppet valve 24 into the open position from the closed position, the controller 56 energizes the actuator 54 thereby causing the actuator 54 to overcome the bias force of the first spool valve spring 58 and drive the first spool valve 42 downward, such that the intermediate channel 50 is in fluid communication with the high pressure line 62. The first and second on/off valves 98 and 110 remain open so that the second fluid chamber 36 and the third fluid chamber 86 are in fluid communication with the fluid reservoir 106 via the respective low pressure lines 108 and 118. Fluid is communicated under pressure to the first fluid chamber 32 through the driving channel 76. When the force of the pressurized fluid operating on the first piston 34 is sufficient to overcome the force of the valve spring 38, the poppet valve 24 is biased to the open position.

To stop the poppet valve 24 at a predetermined lift position, such as when operating in a variable valve lift mode, the controller 56 commands the second on/off valve 110 to open and the first on/off valve 98 to close thereby disallowing fluid communication between the second fluid chamber 36 and the fluid reservoir 106. As the poppet valve 24 opens, the first piston 34 urges fluid within the second fluid chamber 36 into the fourth fluid chamber 90 via the feedback channel 80, which drives the second spool valve 49 upward within the bore 70. This upward motion continues until the second spool valve 49 blocks fluid communication between the driving channel 76 and the intermediate channel 50 and reaches its mechanical stop. When the second spool valve 49 reaches this equilibrium point, the poppet valve 24 will stop at a desired lift position. It should be appreciated that the desired lift position is determined by the operational timing of the first on/off valve 98, which is controlled by the controller 56.

To close the poppet valve 24, the controller 56 de-energizes the actuator 54. The first spool valve spring 58 then operates to bias the first spool valve 42 upward to expose the intermediate channel 50 to the low pressure line 66 and therefore the fluid reservoir 64. The first on/off valve 98 is commanded open by the controller 56 so that the second fluid chamber 36 is in fluid communication with the fluid reservoir 106. The second spool valve spring 94 and third spool valve spring 96 cooperate with the respective spring retainers 128 and 130 to bias the second spool valve 49 to the center biased position. The pressurized fluid within the first fluid chamber 32 will exhaust to the fluid reservoir 64 via the driving channel 76, while the valve spring 38 operates to bias the poppet valve 24 to the closed position. It should be appreciated that the first and second on/off valves 98 and 110 are commanded open so that both the second fluid chamber 36 and the third fluid chamber 86 are in fluid communication with the fluid reservoir 106, causing the low pressure fluid to fill the second and third fluid chambers 36 and 86 as the poppet valve 24 closes.

To stop the poppet valve 24 at a predetermined position while the poppet valve 24 is returning to the closed position, the controller 56 commands the second on/off valve 110 to close thereby disallowing fluid communication between the third fluid chamber 86 and the fluid reservoir 106. As the poppet valve 24 closes, it will displace fluid from within the third fluid chamber 86 into the fifth fluid chamber 92 thereby driving the second spool valve 49 downward. This motion continues until the second spool valve 49 restricts fluid communication between the intermediate channel 50 and the driving channel 76 and reaches its mechanical stop. When the second spool valve 49 reaches this equilibrium point, the poppet valve 24 will stop in an engine valve seating position. It should be appreciated that this feature allows for better control of the impact velocity as the head portion 28 of the poppet valve 24 impacts the seat 40 during the closing movement of the poppet valve 24.

The valve actuator assembly 10 of the present invention is made open-loop stable by utilizing the hydraulic feedback channels 80 and 84 and the on/off valves 98 and 110 are used to selectively pressurize or depressurize the feedback channels 80 and 84, respectively. Open-loop stability implies that a system's response to a given input signal is bounded. The better controllability achieved by open loop stability enables the valve actuator assembly 10 to provide better performance. The valve actuator assembly 10 of the present invention precisely controls the motion of the second spool valve 49 through the feedback channels 80 and 84. Additionally, the center biased with detent feature of the second spool valve 49 is enabled by the fact that the preload of only one spool valve spring 94 or 96 acts on the second spool valve 49 when the second spool valve 49 is biased from the center biased position, as shown in FIGS. 2 and 3. The detent feature of the second spool valve 49 allows the second spool valve 49 to remain in the center biased position in the presence of slight pressure variations between the fourth fluid chamber 90 and the fifth fluid chamber 92, thereby enabling accurate and precise control of the opening and closing of the poppet valve 24.

While the best modes for carrying out the invention have been described in detail, those familiar with the art to which this invention relates will recognize various alternative designs and embodiments for practicing the invention within the scope of the appended claims.

The invention claimed is:

1. A valve actuator assembly for an internal combustion engine comprising:

a housing;

a movable poppet valve;

a movable first spool valve;

a movable second spool valve having a center biased position and detent feature;

a driving channel interconnecting said second spool valve and said poppet valve;

an intermediate channel interconnecting said first spool valve and said second spool valve;

a first feedback channel interconnecting said second spool valve and said poppet valve;

a second feedback channel interconnecting said second spool valve and said poppet valve;

an actuator operatively cooperating with said first spool valve to position said first spool valve thereby selectively allowing fluid flow in and out of said second spool valve and said driving channel to position said poppet valve;

a first on/off valve in fluid communication with said first feedback channel to selectively exhaust said first feedback channel; and a second on/off valve in fluid communication with said second feedback channel to selectively exhaust said second feedback channel, whereby the first on/off valve and the second on/off valve control motion of the second spool valve;

wherein said detent feature includes a second spool valve spring preloaded between a first spring retainer and said housing, and a third spool valve spring preloaded between a second spring retainer and said housing; and wherein the preload of only one of said second and third spool valve springs is applied to said second spool valve when displaced from said center biased position.

2. The valve actuator assembly of claim 1, wherein said housing defines a first fluid chamber in fluid communication with said driving channel and a second fluid chamber in fluid communication with said first feedback channel.

3. The valve actuator assembly of claim 2, further comprising a first piston operatively cooperating with said poppet valve, wherein said first piston is disposed in said housing and has said first fluid chamber on one side and said second fluid chamber on an opposite side.

4. The valve actuator assembly of claim 2, wherein said housing defines a third fluid chamber in fluid communication with said second feedback channel; and wherein the valve actuator assembly further includes a second piston operatively cooperating with said poppet valve, wherein said second piston is disposed in said housing and has said third fluid chamber on one side thereof.

5. The valve actuator assembly of claim 4, further comprising:

a first on/off valve channel interconnecting said second fluid chamber and said first on/off valve;

a second on/off valve channel interconnecting said third fluid chamber and said second on/off valve.

6. The valve actuator assembly of claim 4, further comprising:

a fourth fluid chamber defined by said housing and disposed at one end of said second spool valve, wherein said fourth fluid chamber is in fluid communication with said first feedback channel;

a fifth fluid chamber defined by said housing and disposed at one end of said second spool valve opposite said fourth fluid chamber, wherein said fifth fluid chamber is in fluid communication with said second feedback channel;

wherein said second spool valve spring and said first spring retainer are at least partially disposed within said fourth fluid chamber and operable to bias said second spool valve toward said center biased position;

wherein said third spool valve spring and said second spring retainer are at least partially disposed within said fifth fluid chamber and operable to bias said second spool valve toward said center biased position.

7. An internal combustion engine having an engine block with a cylinder head mounted thereto, wherein the cylinder head includes at least one poppet valve movable therein, the internal combustion engine comprising:

a valve actuator assembly mounted with respect to the cylinder head, the valve actuator assembly including:

a housing;

a movable poppet valve;

a movable first spool valve;

a movable second spool valve having a center biased position and detent;

a driving channel interconnecting said second spool valve and said poppet valve;

an intermediate channel interconnecting said first spool valve and said second spool valve;

a first feedback channel interconnecting said second spool valve and said poppet valve;

a second feedback channel interconnecting said second spool valve and said poppet valve;

an actuator operatively cooperating with said first spool valve to position said first spool valve thereby selectively allowing fluid flow in and out of said second spool valve and said driving channel to position said poppet valve;

a first on/off valve in fluid communication with said first feedback channel to selectively exhaust said first feedback channel;

a second on/off valve in fluid communication with said second feedback channel to selectively exhaust said second feedback channel, whereby the first on/off valve and the second on/off valve control motion of the second spool valve;

a first fluid chamber defined by said housing and disposed in fluid communication with said driving channel;

a second fluid chamber defined by said housing and disposed in fluid communication with said first feedback channel;

a third fluid chamber defined by said housing and disposed in fluid communication with said second feedback channel;

a fourth fluid chamber defined by said housing and disposed at one end of said second spool valve, wherein said fourth fluid chamber is in fluid communication with said first feedback channel;

a fifth fluid chamber defined by said housing and disposed at one end of said second spool valve opposite said fourth fluid chamber, wherein said fifth fluid chamber is in fluid communication with said second feedback channel;

a first piston operatively cooperating with said poppet valve, wherein said first piston is disposed in said housing and has said first fluid chamber on one side and said second fluid chamber on an opposite side;

a second piston operatively cooperating with said poppet valve and being disposed in said housing and having said third fluid chamber on one side thereof;

a second spool valve spring intermediate a first spring retainer and said housing, said first spring retainer and second spool valve at least partially disposed within said fourth fluid chamber and operable to bias said second spool valve toward said center biased position;

a third spool valve spring intermediate a second spring retainer and said housing, said second spring retainer and third spool valve at least partially disposed within said fifth fluid chamber and operable to bias said second spool valve toward said center biased position; and wherein said second spool valve spring and retainer and said third spool valve spring and retainer cooperate to provide said detent feature to said second spool valve; and wherein only one of said second and third spool valve springs is in operative communication with said second spool valve when displaced from said center biased position.

* * * * *